US008542151B2

(12) United States Patent
Lin et al.

(10) Patent No.: US 8,542,151 B2
(45) Date of Patent: Sep. 24, 2013

(54) ANTENNA MODULE AND ANTENNA UNIT THEREOF

(75) Inventors: Yi-Cheng Lin, Taipei (TW); Ho-Chung Chen, Taipei (TW); Kuo-Fong Hung, Changhua (TW)

(73) Assignees: Mediatek Inc., Hsin-Chu (TW); National Taiwan University, Taipei (TW)

( * ) Notice: Subject to any disclaimer, the term of this patent is extended or adjusted under 35 U.S.C. 154(b) by 378 days.

(21) Appl. No.: 12/909,279

(22) Filed: Oct. 21, 2010

(65) Prior Publication Data

US 2012/0098706 A1 Apr. 26, 2012

(51) Int. Cl.
*H01Q 1/38* (2006.01)

(52) U.S. Cl.
USPC ..... 343/700 MS; 343/846

(58) Field of Classification Search
USPC ..... 343/700 MS, 846, 848
See application file for complete search history.

(56) References Cited

U.S. PATENT DOCUMENTS

| | | | | |
|---|---|---|---|---|
| 4,197,544 | A | 4/1980 | Kaloi | |
| 6,034,637 | A | 3/2000 | McCoy et al. | |
| 6,642,908 | B2 | 11/2003 | Pleva et al. | |
| 6,836,247 | B2 | 12/2004 | Soutiaguine et al. | |
| 7,429,952 | B2 | 9/2008 | Sun | |
| 7,808,439 | B2 | 10/2010 | Yang et al. | |
| 2004/0056803 | A1 | 3/2004 | Soutioguine et al. | |
| 2007/0052504 | A1 | 3/2007 | Fujita | |
| 2007/0080864 | A1 | 4/2007 | Channabasappa | |
| 2007/0262828 | A1* | 11/2007 | Fujita | 333/26 |
| 2008/0068269 | A1 | 3/2008 | Yamada | |
| 2008/0191953 | A1 | 8/2008 | Bruno et al. | |
| 2009/0224857 | A1* | 9/2009 | Fujita | 333/239 |
| 2010/0116675 | A1 | 5/2010 | Sklar et al. | |

FOREIGN PATENT DOCUMENTS

| | | |
|---|---|---|
| DE | 10 2006 041994 | 4/2007 |
| DE | 10 2007 005928 | 8/2007 |
| EP | 1 775 795 | 4/2007 |
| FR | 2 651 926 | 3/1991 |

(Continued)

OTHER PUBLICATIONS

Van Beurden, M.C., et al; "Analysis of Wide-Band Infinite Phased Arrays of Printed Folded Dipoles Embedded in Metallic Boxes;" IEEE Transactions on Antennas and Propagation; vol. 50; No. 9; Sep. 2002; pp. 1266-1273.

(Continued)

*Primary Examiner* — Hoanganh Le
(74) *Attorney, Agent, or Firm* — McClure, Qualey & Rodack, LLP

(57) ABSTRACT

An antenna unit is provided. The antenna unit includes a first substrate, a first conductive layer, a second conductive layer, a plurality of conductive vias, a feed conductor and a patch. The first substrate includes a first surface and a second surface, wherein the first surface is opposite to the second surface. The first conductive layer is disposed on the first surface. The second conductive layer is disposed on the second surface, wherein an opening is formed on the second conductive layer, and the opening has an opening edge. The conductive vias are formed in the first substrate and connect the first conductive layer to the second conductive layer, wherein the conductive vias surround the opening to define a cavity. The feed conductor extends above the opening to feed a wireless signal to the antenna unit. The patch is disposed above the opening and is separated from the feed conductor.

20 Claims, 9 Drawing Sheets

(56) References Cited

FOREIGN PATENT DOCUMENTS

| | | |
|---|---|---|
| JP | A 1997-1083232 | 3/1997 |
| JP | 2000-261235 | 9/2000 |
| JP | A 2004-507138 | 3/2004 |
| JP | A 2006-500821 | 1/2006 |
| JP | A 2004-507138 | 4/2007 |
| WO | 0215334 | 2/2002 |
| WO | WO 2008/069493 | 6/2008 |

OTHER PUBLICATIONS

Zwick, T., et al; "Broadband Planar Superstrate Antenna for Integrated Millimeterwave Transceivers;" IEEE Transactions on Antennas and Propagation; vol. 54; No. 10; Oct. 2006; pp. 2790-2796.

Lin, Y.C., et al; "Design of Dual-Band Slot Antenna with Double T-Match Stubs;" Electronics Letters; vol. 42; No. 8; Apr. 2006; pp. 1-2.

Hung, K.F.; "Novel Broadband Circularly Polarized Cavity-Backed Aperture Antenna with Traveling Wave Excitation;" IEEE Transactions on Antennas and Propagation; vol. 58; No. 1; Jan. 2010; pp. 35-42.

English language translation of abstract of FR 2 651 926 (published Mar. 15, 1991).

English language translation of abstract of DE 10 2006 041 994 (published Apr. 5, 2007).

English language translation of abstract of DE 10 2007 005 928 (published Aug. 23, 2007).

English language translation of abstract of JP 2000-261235 (published Sep. 22, 2000).

English language translation (machine translation) of JPA 1997-1083232 (published Mar. 28, 1997).

English language translation of abstract of JPA 2007-88883 (published Apr. 5, 2007).

* cited by examiner

ANTENNA MODULE AND ANTENNA UNIT THEREOF

BACKGROUND OF THE INVENTION

1. Field of the Invention

The present invention relates to an antenna module, and in particular relates to an antenna module and cavity-backed stacked planar antenna unit thereof.

2. Description of the Related Art

FIG. 1 shows a conventional antenna 1, including an antenna substrate 10, a feed substrate 20, a microstrip patch 30, a ground plane 40 and a microstrip feed line 50. The antenna substrate 10 includes a first surface 11 and a second surface 12. The feed substrate 20 includes a third surface 21 and a fourth surface 22. The microstrip patch 30 is disposed on the first surface 11. The ground plane 40 is disposed on the third surface 21. The second surface 12 is connected to the ground plane 40. A coupling aperture 41 is formed on the ground plane 40. The microstrip feed line 50 is disposed on the fourth surface 22. The microstrip feed line 50 feeds wireless signals via the coupling aperture 41 to the microstrip patch 30. Conventional antennas typically have small bandwidths, unignored back radiation and unwanted surface wave radiation issues.

BRIEF SUMMARY OF THE INVENTION

An antenna unit is provided. The antenna unit includes a first substrate, a first conductive layer, a second conductive layer, a plurality of conductive vias, a feed conductor and a patch. The first substrate includes a first surface and a second surface, wherein the first surface is opposite to the second surface. The first conductive layer is disposed on the first surface. The second conductive layer is disposed on the second surface, wherein an opening is formed on the second conductive layer, and the opening has an opening edge. The conductive vias are formed in the first substrate and connect the first conductive layer to the second conductive layer, wherein the conductive vias surround the opening to define a cavity. The feed conductor extends above the opening to feed a wireless signal to the antenna unit. The patch is disposed above the opening and is separated from the feed conductor.

Utilizing the antenna unit of the embodiment of the invention, an electric field $\overline{E}$ is formed between the patch, the feed conductor and the opening edge of the second conductive layer to enhance the oblique resonant directions. With the oblique resonant directions, the antenna unit of the embodiment of the invention has broader beamwidth. Additionally, the antenna unit or antenna array module of the embodiments of the invention can be easily mass produced by a standard low-cost PCB process.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
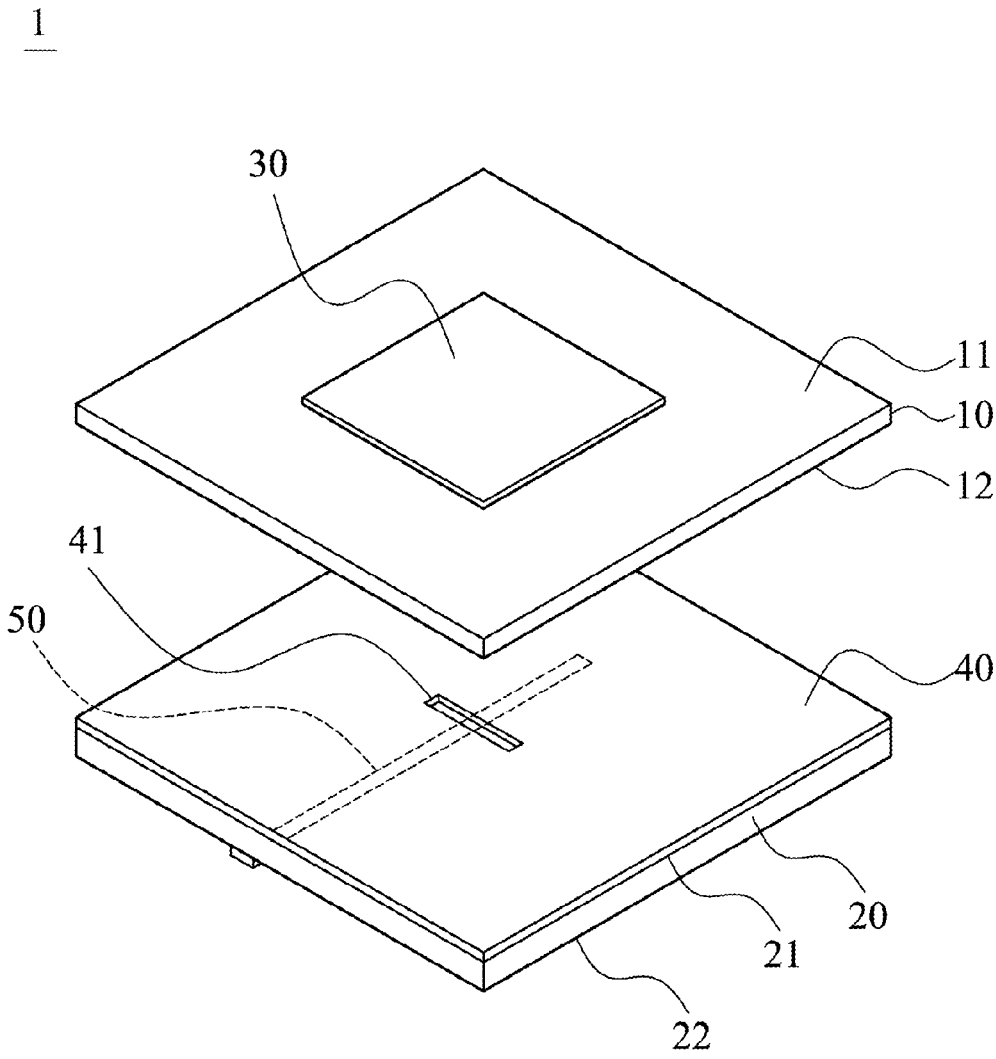
FIG. 1 shows a conventional antenna.
Figure 2:
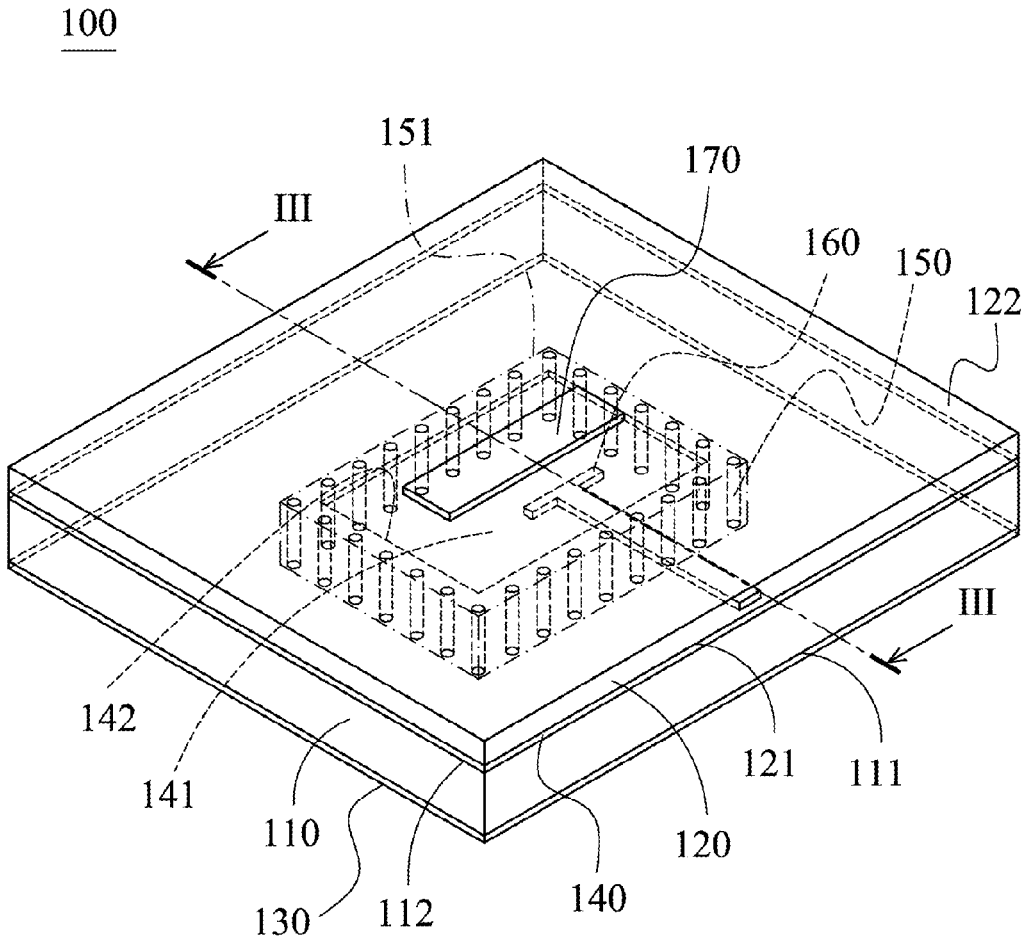
FIG. 2 shows an antenna unit of an embodiment of the invention.

FIG. 2 shows an antenna unit 100 of an embodiment of the invention. The antenna unit 100 includes a first substrate 110, a second substrate 120, a first conductive layer 130, a second conductive layer 140, a plurality of conductive vias 150, a feed conductor 160 and a patch 170. The first substrate 110 includes a first surface 111 and a second surface 112, wherein the first surface 111 is opposite to the second surface 112. The second substrate 120 includes a third surface 121 and a fourth surface 122, the third surface 121 is opposite to the fourth surface 122. The first conductive layer 130 is disposed on the first surface 111. The second conductive layer 140 is disposed on the second surface 112, wherein an opening 141 is formed on the second conductive layer 140, and the opening 141 has an opening edge 142. The conductive vias 150 are formed in the first substrate 110 and connect the first conductive layer 130 to the second conductive layer 140, wherein the conductive vias 150 surrounds the opening 141 to define a cavity 151. The cavity 151 is formed by the conductive vias 150 and the first conductive layer 130. The feed conductor 160 extends above the opening 141 to feed a wireless signal to the antenna unit 100. The patch 170 is disposed above the opening 141 and is separated from the feed conductor 160. In this embodiment, the first conductive layer 130 and the second conductive layer 140 are ground layers.

Figure 3:
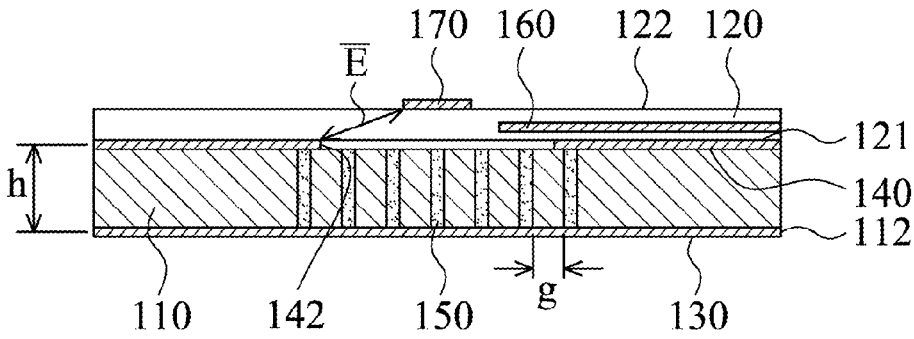
FIG. 3 is a sectional view along direction III-III of FIG. 2.

FIG. 3 is a sectional view along direction III-III of FIG. 2. As shown in FIG. 3, the patch 170 is disposed on the fourth surface 122, and the third surface 121 contacts the second conductive layer 140. In this embodiment, the feed conductor 160 is embedded in the second substrate 120.

Figure 4:
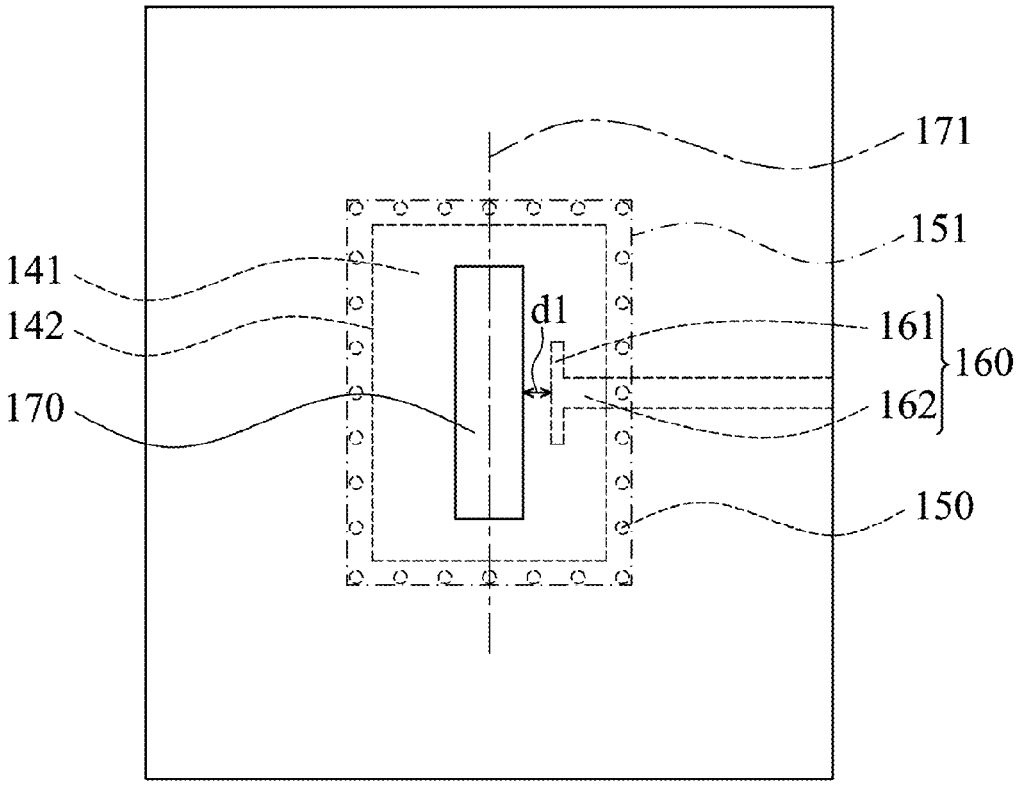
FIG. 4 is a top view of the antenna unit.

FIG. 4 is a top view of the antenna unit 100. The feed conductor 160 is T shaped, and includes a first section 161 and a second section 162, wherein an end of the second section 162 is connected to the first section 161. The patch 170 is rectangular, and has a major axis 171, and the first section 161 of the feed conductor 160 is parallel to the major axis 171. The opening 141 is rectangular. A space d1 between the first section 161 and the patch 170 is about 0.15λ, and λ is a wavelength of the wireless signal. By changing the space d1 or the width of the opening 141 which is parallel to axis 171, the impedance matching may be modified. By changing the length of the opening 141 which is perpendicular to axis 171, the resonated center frequency of the antenna may be shifted. By changing the distance between the patch 170 and the opening edge 142, the bandwidth of the antenna unit may be modified. With further reference to FIG. 3, a height h between the first conductive layer 130 and the second conductive layer 140 is about 0.25λ. A gap g between each two conductive vias is designed smaller than λ/8. The height h and gap g may also be modified.

Figure 5:
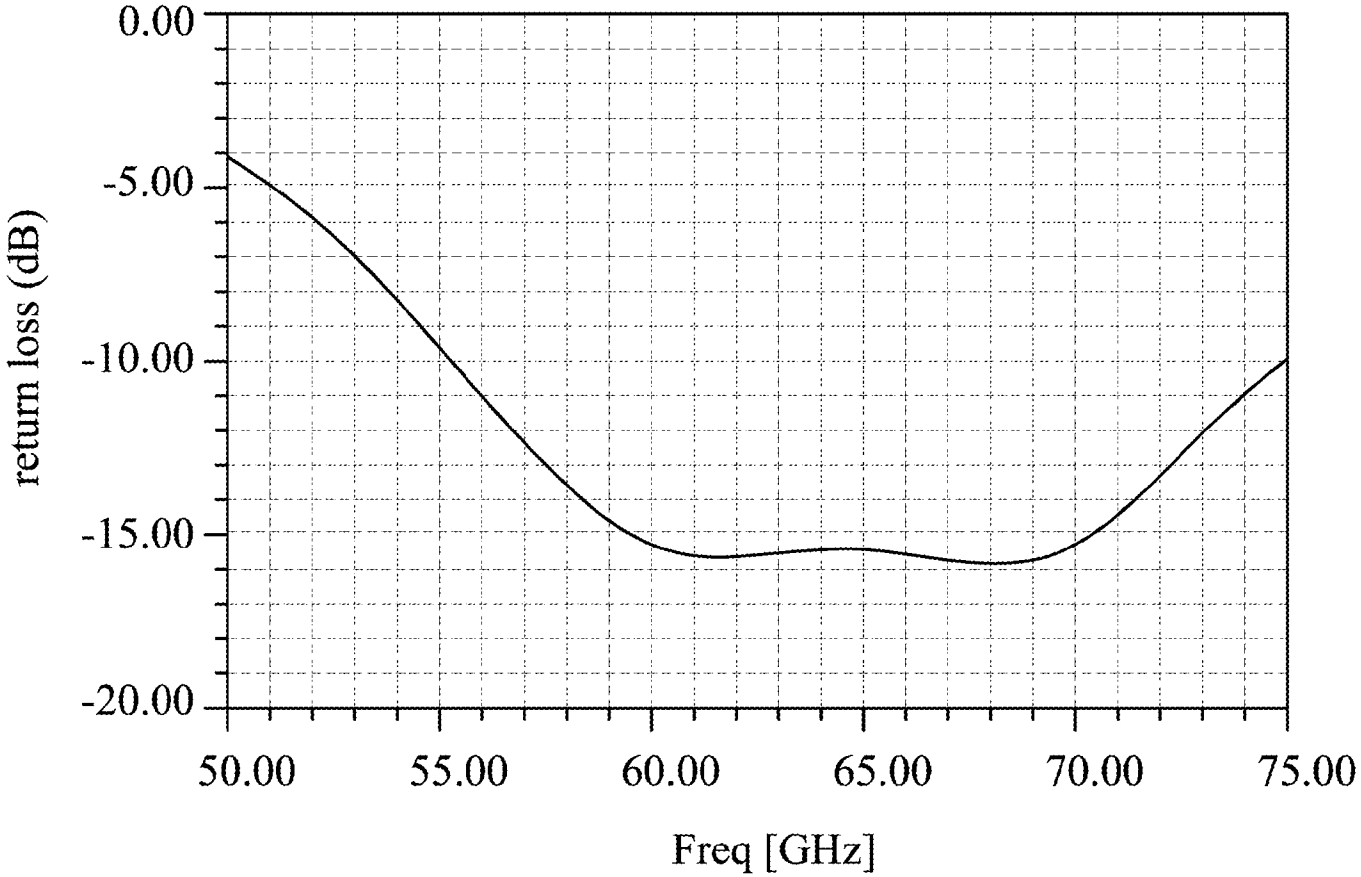
FIG. 5 shows the input impedance (S11) of the antenna unit.
Figure 6A:
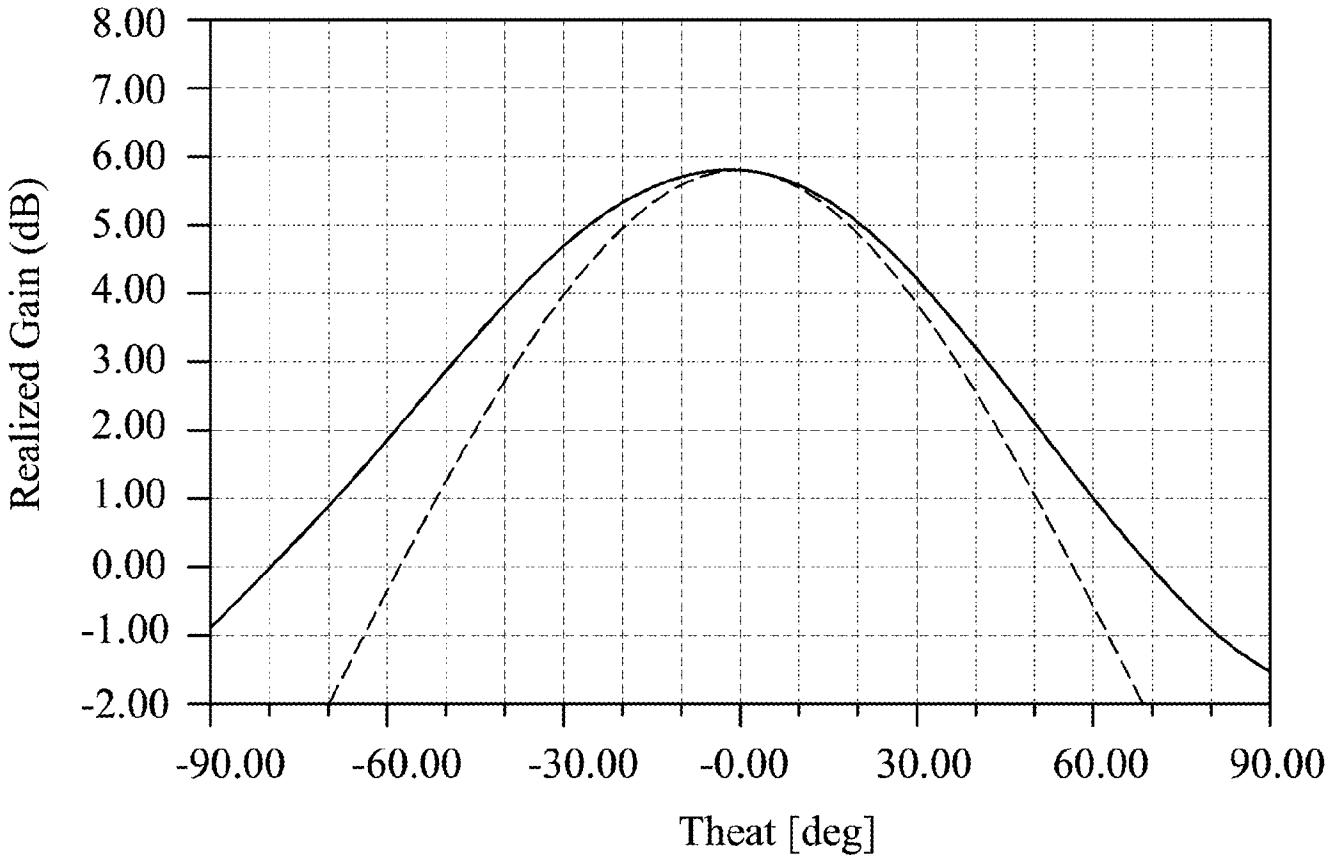
FIG. 6*a* shows the E and H plane antenna patterns at 57 GHz of the antenna unit.
Figure 6B:
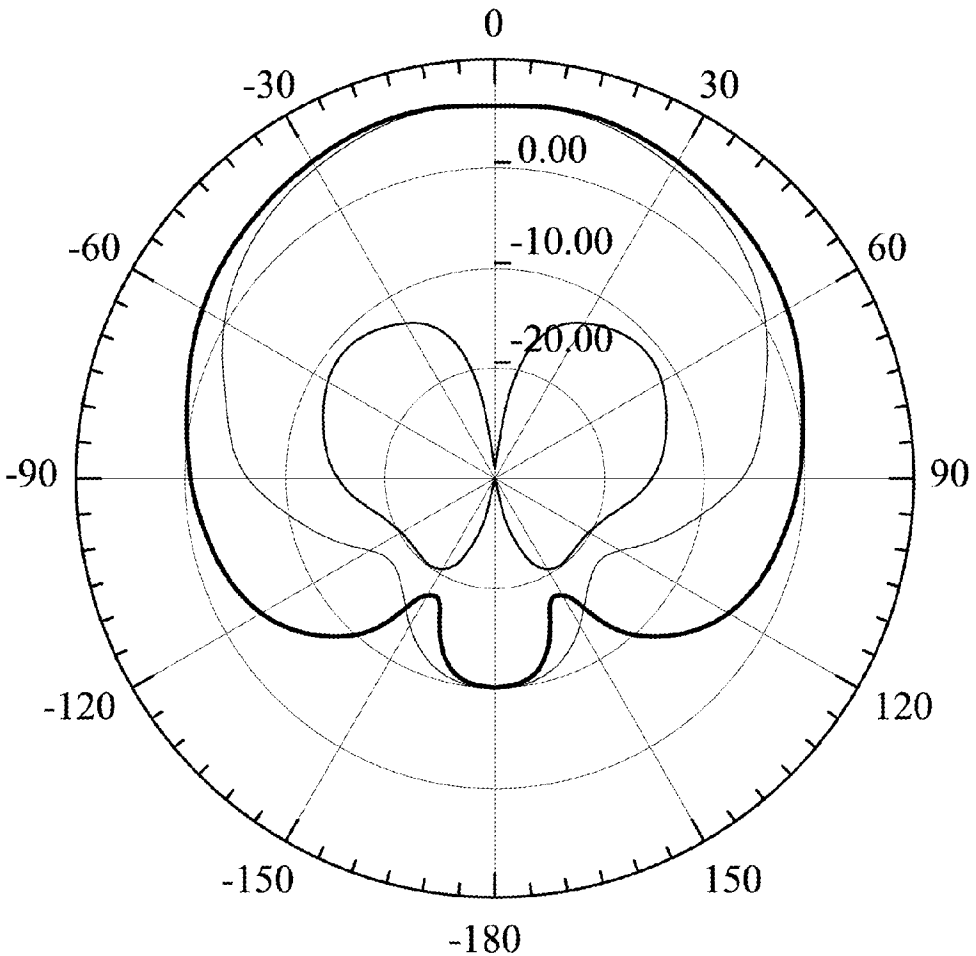
FIG. 6*b* shows the small back radiation characteristic at 57 GHz of the antenna unit.
Figure 7A:
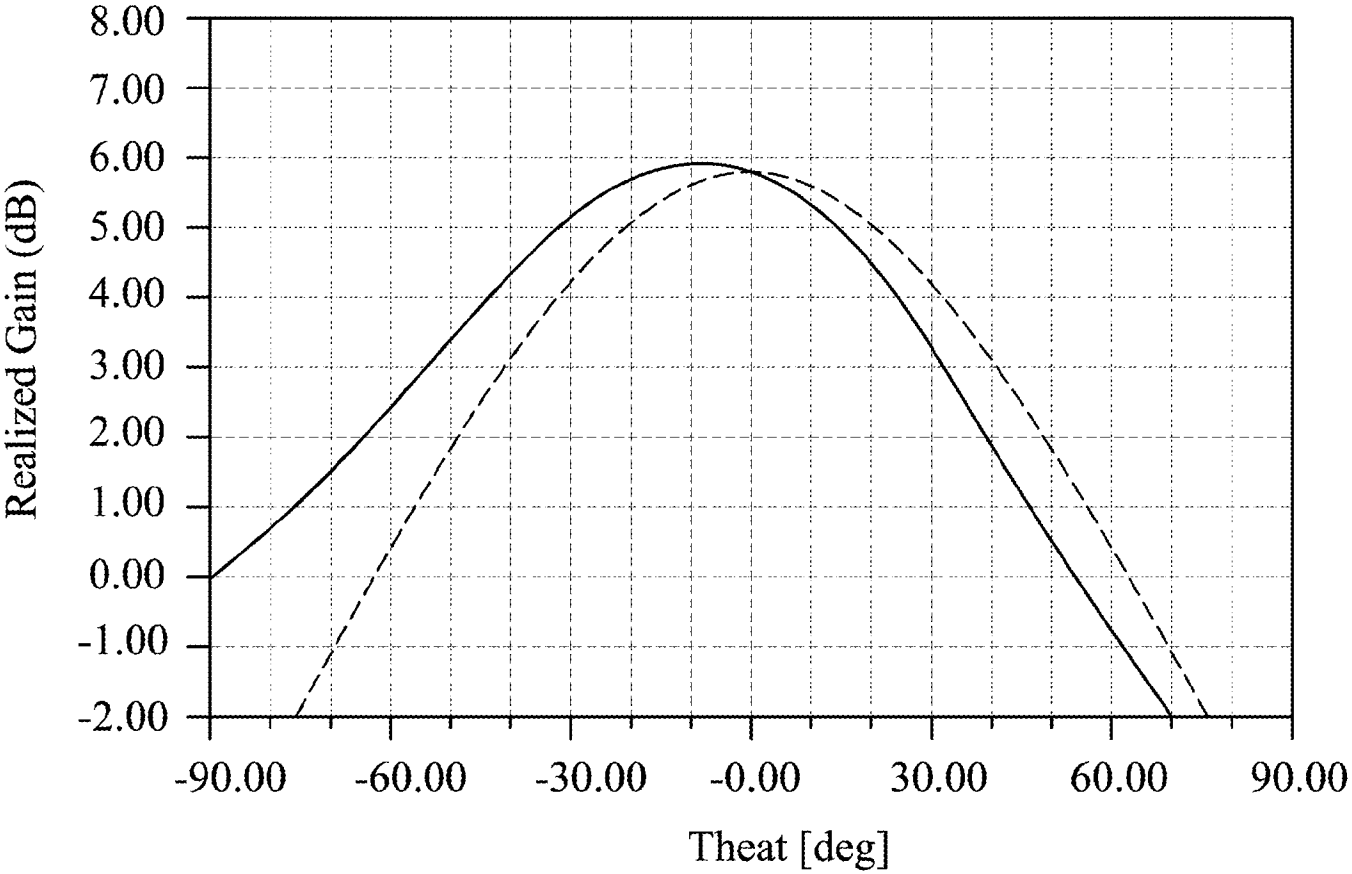
FIG. 7*a* shows the E and H plane antenna patterns at 66 GHz of the antenna unit.
Figure 7B:
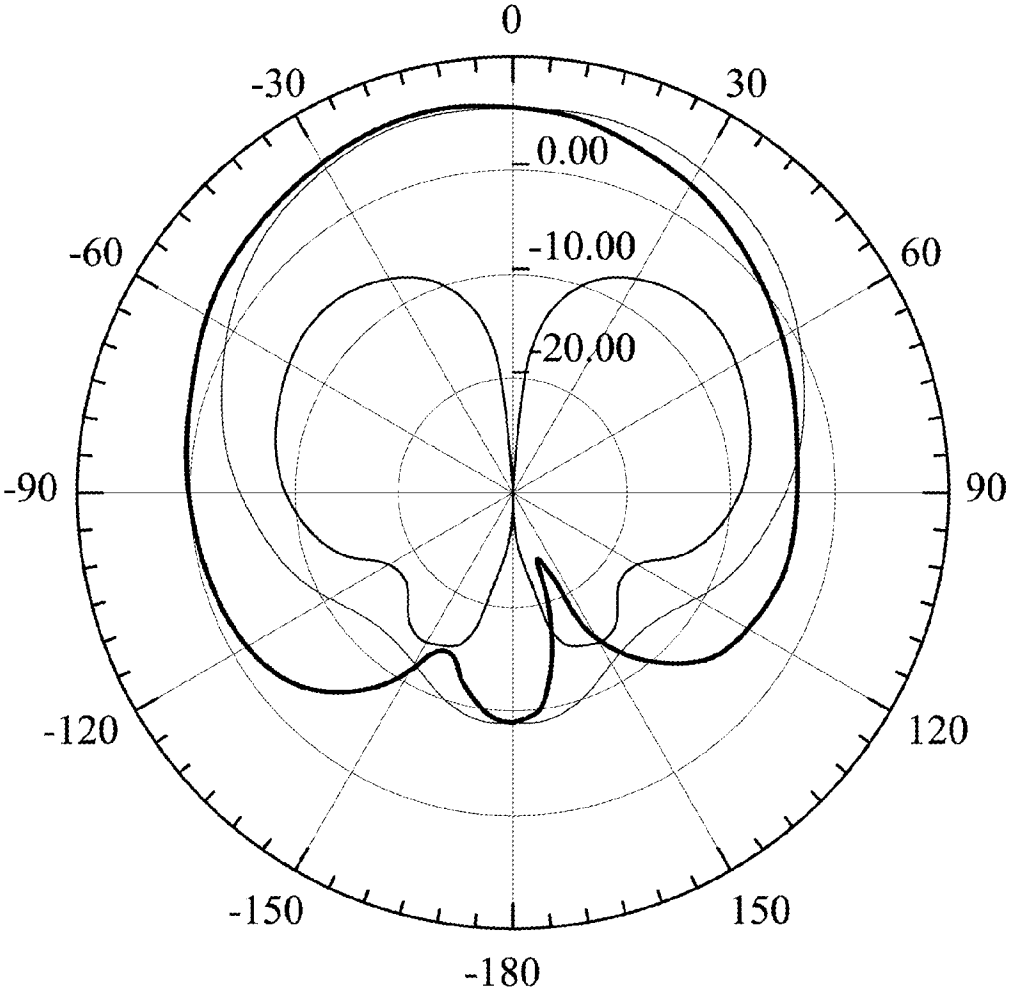
FIG. 7*b* shows the small back radiation characteristic at 66 GHz of the antenna unit.

With reference to FIG. 3, an electric field $\bar{E}$ is formed between the patch 170 and the opening edge 142, the electric field $\bar{E}$ has oblique resonant direction relative to the second conductive layer 140. With the oblique resonant direction, the antenna unit of the embodiment of the invention has broader beamwidth. FIG. 5 shows the input return loss (S11) of the antenna unit 100, wherein the antenna unit 100 has an ultra-large fractional bandwidth which is near 25%. FIG. 6*a* shows the E and H plane antenna patterns at 57 GHz of the antenna unit 100. FIG. 6*b* shows the small back radiation characteristic at 57 GHz of the antenna unit 100. FIG. 7*a* shows the E and H plane antenna patterns at 66 GHz of the antenna unit 100. FIG. 7*b* shows the small back radiation characteristic at 66 GHz of the antenna unit 100. As shown in FIGS. 6*a*, 6*b*, 7*a* and 7*b*, the antenna unit of the invention provides a peak gain which is higher than 6 dBi.

In the embodiment above, the cavity 151 and the opening 141 are rectangular. However, the invention is not limited thereto. The rectangular cavity 151 and opening 141 may also be implemented by circular, elliptic and other opening shapes.

In the embodiment above, the feed conductor 160 is T shaped. However, the invention is not limited thereto. The feed conductor 160 here is embedded in the second substrate 120, strip-line structure. However, the invention is not limited thereby and other transmission line structures may also be implemented. Additionally, the extending direction or shape of the second section 162 may also be modified.

In the embodiment above, the patch 170 is disposed on the fourth surface 122. However, the invention is not limited thereby. The patch 170 and the feed conductor 160 may also be located on a same plane. For example, both the patch 170 and the feed conductor 160 may be disposed on the fourth surface 122. Or, the patch 170 may be disposed on the third surface 121, and the feed conductor 160 is placed on the fourth surface 122.

Figure 8:
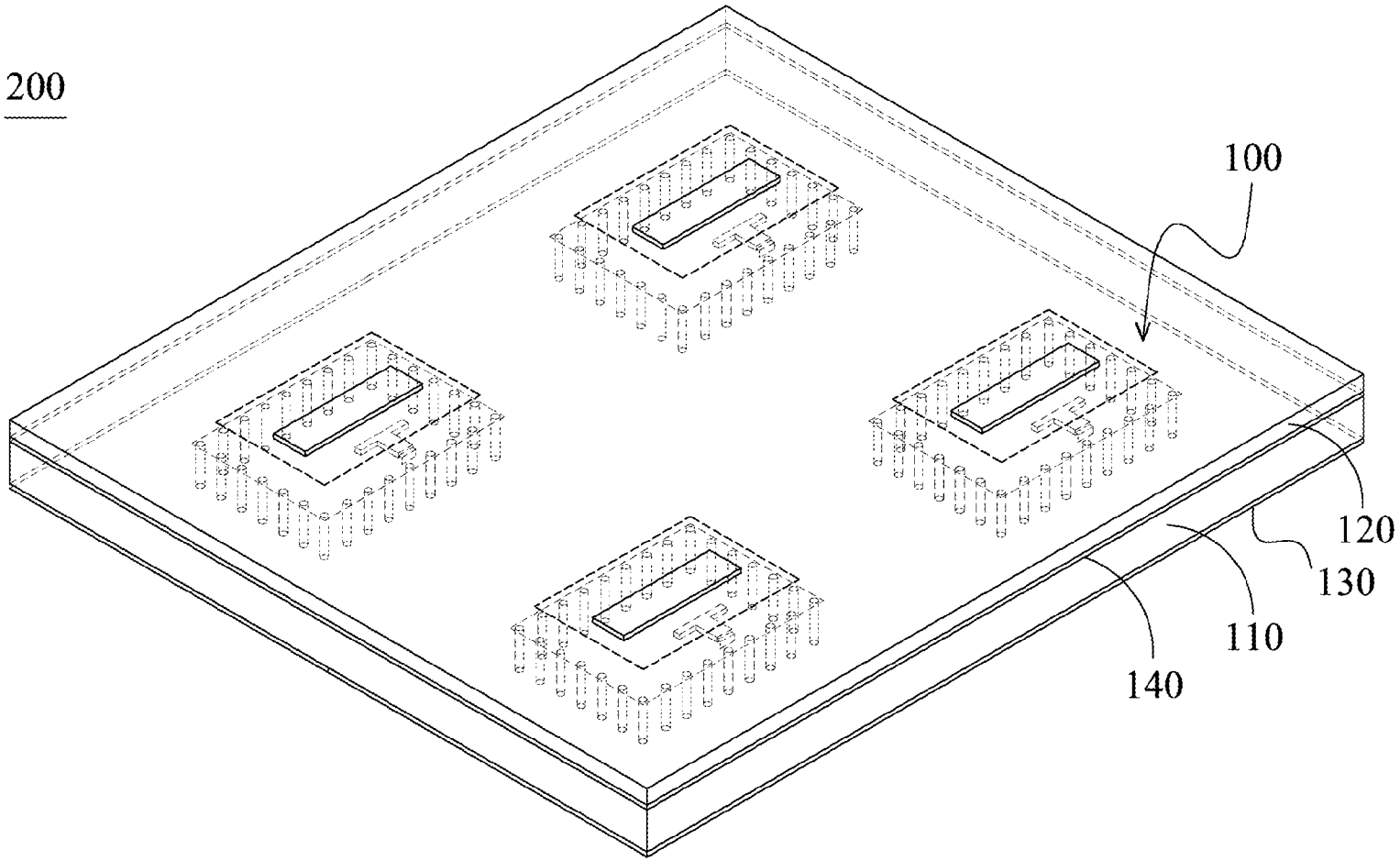
FIG. 8 shows an antenna array module of an embodiment of the invention.

FIG. 8 shows an antenna array module 200 of an embodiment of the invention, wherein the antenna units 100 of the embodiment of the invention are formed on a same first substrate 110, second substrate 120, first conductive layer 130 and second conductive layer 140. The antenna array module 200 of the embodiment of the invention provides improved isolation between the antenna units 100 (more than 15 dB). In this embodiment, spaces between the antenna units 100 are nearly 0.5λ. The antenna unit 100 or the antenna array module 200 of the embodiments of the invention may be easily mass produced by a standard low-cost PCB process.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna unit, comprising:
- a first substrate, comprising a first surface and a second surface, wherein the first surface is opposite to the second surface;
- a first conductive layer, disposed on the first surface; and
- a second conductive layer, disposed on the second surface, wherein an opening is formed on the second conductive layer, and the opening has an opening edge;
- a plurality of conductive vias, formed in the first substrate and connecting the first conductive layer to the second conductive layer, wherein the conductive vias surround the opening to define a cavity;
- a feed conductor, extending above the opening to feed a wireless signal to the antenna unit; and
- a patch, disposed above the opening and separated from the feed conductor;

wherein the feed conductor and the patch do not overlap.

2. The antenna unit as claimed in claim 1, wherein an electric field is formed between the patch, the feed conductor and the opening edge, to enhance the oblique resonant directions relative to the second conductive layer.

3. The antenna unit as claimed in claim 1, further comprising a second substrate, wherein the second substrate comprises a third surface and a fourth surface, the third surface is opposite to the fourth surface, the patch is disposed on the fourth surface, and the third surface contacts the second conductive layer.

4. The antenna unit as claimed in claim 3, wherein the feed conductor is embedded in the second substrate.

5. The antenna unit as claimed in claim 3, wherein the feed conductor is disposed on the fourth surface.

6. The antenna unit as claimed in claim 1, wherein the patch is rectangular, the patch has a major axis, and the first section of the feed conductor is parallel to the major axis.

7. The antenna unit as claimed in claim 6, wherein a space between the first section and the patch is about 0.15λ, and λ is wavelength of the wireless signal.

8. The antenna unit as claimed in claim 1, wherein the opening is rectangular, and the patch is rectangular.

9. The antenna unit as claimed in claim 1, wherein a height between the first conductive layer and the second conductive layer is about 0.25λ, and λ is a wavelength of the wireless signal.

10. The antenna unit as claimed in claim 1, wherein a gap between each two conductive vias is designed smaller than λ/8, where λ is wavelength of the wireless signal.

11. The antenna unit as claimed in claim 1, wherein the first conductive layer and the second conductive layer are ground layers.

12. The antenna unit as claimed in claim 1, wherein the feed conductor is T shaped, and the feed conductor comprises a first section and a second section, and an end of the second section is connected to the first section.

13. An antenna array module, comprising:
- a first substrate, comprising a first surface and a second surface, wherein the first surface is opposite to the second surface;
- a first conductive layer, disposed on the first surface;
- a second conductive layer, disposed on the second surface; and
- a plurality of antenna units, wherein the antenna units are arranged in matrix, and each antenna unit has:
- an opening, formed on the second conductive layer, wherein the opening has an opening edge;
- a plurality of conductive vias, formed in the first substrate and connecting the first conductive layer to the second conductive layer, wherein the conductive vias surround the opening to define a cavity;

a feed conductor, extending above the opening to feed a wireless signal to the antenna unit; and a patch, disposed above the opening and separated from the feed conductor;

wherein the feed conductor and the patch do not overlap.

14. The antenna array module as claimed in claim 13, further comprising a second substrate, wherein the second substrate comprises a third surface and a fourth surface, the third surface is opposite to the fourth surface, the patch of each antenna unit is disposed on the fourth surface, and the third surface contacts the second conductive layer.

15. The antenna array module as claimed in claim 14, wherein the feed conductor of each antenna unit is embedded in the second substrate.

16. The antenna array module as claimed in claim 13, wherein the feed conductor of each antenna unit is T shaped, and the feed conductor of each antenna unit comprises a first section and a second section, and an end of the second section is connected to the first section.

17. The antenna array module as claimed in claim 16, wherein the patch of each antenna unit is rectangular, the patch of each antenna unit has a major axis, and the first section of the feed conductor of each antenna unit is parallel to the major axis.

18. The antenna array module as claimed in claim 13, wherein the opening of each antenna unit is rectangular, and the patch of each antenna unit is rectangular.

19. The antenna array module as claimed in claim 13, wherein the first conductive layer and the second conductive layer are ground layers.

20. An antenna unit, comprising:

a first substrate, comprising a first surface and a second surface, wherein the first surface is opposite to the second surface;

a conductive layer, disposed on the second surface, wherein an opening is formed on the conductive layer;

a conductive cavity, formed in the first substrate and enclosing the opening, wherein the conductive cavity is electrically connected to the conductive layer;

a feed conductor, extending above the opening to feed a wireless signal to the antenna unit; and a patch, disposed above the opening and separated from the feed conductor, wherein the feed conductor and the patch do not overlap.

* * * * *